United States Patent [19]

Kitner et al.

[11] Patent Number: 4,694,770

[45] Date of Patent: Sep. 22, 1987

[54] WATERCRAFT STABILIZING FLOTATION STRUCTURE

[76] Inventors: William M. Kitner, 3515 W. 118 Pl., Inglewood, Calif. 90303; James B. Hart, 227 E. 52nd St., Long Beach, Calif. 90805

[21] Appl. No.: 740,850

[22] PCT Filed: Jul. 30, 1984

[86] PCT No.: PCT/US84/01221

§ 371 Date: May 10, 1985

§ 102(e) Date: May 10, 1985

[87] PCT Pub. No.: WO85/01486

PCT Pub. Date: Apr. 11, 1985

[51] Int. Cl.[4] ..... B63B 35/84

[52] U.S. Cl. ..... 114/123; 114/248; 114/258; 114/352; 114/363; 440/12

[58] Field of Search ..... 114/270, 61, 123, 283, 114/284, 292, 352, 344, 246, 248, 258, 259, 363; 440/11, 12

[56] References Cited

U.S. PATENT DOCUMENTS

| | | | |
|---|---|---|---|
| 3,321,784 | 5/1967 | Rasmussen | 114/61 |
| 3,538,877 | 11/1970 | Moore | 114/61 |
| 3,634,897 | 1/1972 | Cuccio | 114/259 |
| 3,646,904 | 3/1972 | Canning et al. | 114/270 |
| 3,659,546 | 5/1972 | Miklos | 114/259 |
| 3,726,245 | 4/1973 | Critcher | 114/267 |
| 3,756,189 | 9/1973 | Yutzler | 114/270 |
| 4,141,309 | 2/1979 | Halboth | 114/283 |

OTHER PUBLICATIONS

Marine Products catalog, p. 65, 1983.

*Primary Examiner*—Joseph F. Peters, Jr.
*Assistant Examiner*—Thomas J. Brahan
*Attorney, Agent, or Firm*—Albert O. Cota

[57] ABSTRACT

A watercraft stabilizing flotation structure comprising two hulls (23) (25) that surround the outside perimeter of a single-person ski-type powered watercraft to extend the surface area in contact with the water. A seat (36) located at the stern allows the operator to sit during operation of the craft. A removable pin (34) secures the placement of the watercraft at the bow and a pair of straps and buckles (27) hold the hulls (23) and (25) together. The hulls are hollow and watertight providing a flotation chamber for the structure. In another embodiment a set of running lights (48), (50) and (52) are provided for operation in navigable waters. The lights are wired integral with the structure and are energized either by the watercraft's ignition system or an independent battery. A mechanically operated thrust reverser (54) may also be incorporated adjacent to the back of the seat assembly (36), behind the water discharge, to allow the watercraft to reverse direction or add braking capability.

20 Claims, 21 Drawing Figures

WATERCRAFT STABILIZING FLOTATION STRUCTURE

TECHNICAL FIELD

This invention pertains in general to boats having external buoyancy floats, and more specifically to a stabilizing flotation structure designed to be attached to a single-person ski type watercraft.

BACKGROUND ART

Single-person ski-type powered watercraft such as those commonly known by their registered trademark "Jet Ski" manufactured by Kawasaki Jukogyo Kabushiki Kaisha of Kobe, Japan; the Hydro-Ski-Northwest manufactured by Sorrellco, Incorporated, United States of America, and those planned by the Japanese firms of Honda and Yamaha have an inherent problem of instability while in the water. The instability is present when the craft is at rest, when climbing aboard and getting underway, or when operating at very slow speeds.

Because of this instability, the unmodified watercraft has limited utility in that the only water-stable period is when the craft is underway at cruising speeds. Additionally, user comfort is compromised because to operate the watercraft, the operator must remain in a standing or kneeling position.

A search of the prior art did not disclose any patents that read on the claims of the instant invention. However, the following U.S. patents are related and indicative of the state-of-the-art:

| U.S. Pat. No. | INVENTOR | ISSUED |
|---|---|---|
| 4,353,321 | Liu | 12 October 1982 |
| 4,320,713 | Nishida, et al | 23 March 1982 |
| 3,702,106 | Wilder | 7 November 1972 |

The Liu patent describes a watercraft having an integral engine and front-end steering with a separate pontoon. The stability is accomplished with a pair of adjustable flotation pontoons that are extended when stationary and retracted when traveling at higher speeds. The stabilizing members are controlled manually or automatically by a spring loaded mechanism.

The Nishida et al patent attempts to solve the instability problem by permanently adding a float on either side of the hull, pivotally attached, with the capability of being locked into an angular position entirely above the separator rail of the craft. This float is triangular in shape and is less than half of the length of the hull, or at least one-third the total length of the watercraft, also the floats are attached at the rear portion only, and are hinged to retract vertically for transportation while the watercraft is out of the water. Further, a seat for two persons is attached to the hull being of the straddle type, allowing the operator and at least one passenger to sit in tandem.

The Wilder patent discloses a watercraft propelled by an outboard power motor and that uses an outrigger pontoon stabilizing means that extends from an operable position to a retracted inoperable position. Various means are utilized to remotely control this extension and a chair type operators seat is positioned above the top deck of the main hull.

DISCLOSURE OF THE INVENTION

Single-person ski-type watercraft, such as the Kawasaki Jet-Ski, are normally operated from a standing position. These watercraft utilize a jet of water or a propellor for propulsion and have an inherent problem of instability when at rest or at slow speeds. Of particular importance is the difficulty in mounting such a craft when in the water, as stability is achieved only at higher speeds when the dynamic pressure of the water reacts with the moving hull to create lift and a gyro effect of the operator is realized. When the craft is immobile danger of capsizing becomes apparent in both slowing down to a stop and particularly when an operator is boarding the watercraft in open water.

The watercraft was purposely made with a minimum amount of surface area in the hull to maximize speed and manuverability. To further this objective, the operator normally operates the craft from a standing position.

In view of these limitations, the primary object of the invention is to provide stabilization of the craft under all conditions in the water. Thus, increasing the watercraft's utility by making the vehicle usable by those with a lesser range of handling skill and providing increased ease of operation.

An important object provides a planing surface on the hull that enhances the stability of the craft without effectively increasing the drag. This is accomplished by continuing the surface of the underside of the hull in a smooth gradual transition and by adding an internal radial contour on the underside. When the craft is moving at high speed a greater portion of the apparatus is out of the water eliminating most of the surface contact. Some change in operating characteristics are realized at low speeds and in tight cornering, however, little overall effect is produced.

The invention in another object allows easy attachment and removal without any modification to the watercraft. The front hull and rear hulls nest against the watercraft encompassing the watercraft parting rail in channel fashion. The two hulls are centrally attached by a pair of latch-type buckles and a removable pin that is inserted in the respective bows of the front hull and watercraft. Only the pin penetrates the watercraft with the balance of the invention simply held in place by the buckle and the tight-fitting relationship of the hulls. Easy disassembly is achieved with the removal of the bow pin and the release of the buckles.

The only optional modification required to the watercraft is the addition of an electrical receptacle in the engine compartment with internal wiring attached to the ignition system to energize a set of optional running lights. A plug with an extension cable is integral with the hulls and the connecting wiring for the lights are consolidated into the structure.

The addition of the optional running lights to the craft extends the utility of the device to include night time operation. Further, this feature generally improves the safety during periods of poor lighting or adverse environmental conditions.

Still another object provides for human comfort in the form of a seat so arranged as to allow the operator to be seated. The seat may also include a back which adds support when operating the watercraft over distances or long periods of time and human fatigue is a factor. Presently, the watercraft must be driven from a standing position in ski fashion or kneeling, which is stressful to the operator limiting the time of use.

A further object adds an optional hollow wedge box having a rectangular shape with a width and height that allows the box to securely fit under the structures integral seat. The box is used for the storage of goods and is equipped with a lid that incorporates a lid beverage well and that may be used as an auxiliary seat in tandem fashion.

Yet another object incorporates the use of a thrust reverser integral with the stern apparatus. The reverser allows the craft to be reversed in its direction to back out of places such as docks and piers, where manuvering forward is difficult or impossible and it also serves as a braking device.

These and other objects and advantages of the present invention will become apparent from the subsequent detailed description of the preferred embodiment and the claims taken in conjunction with the accompanying drawings.

BEST MODE FOR CARRYING OUT THE INVENTION

The preferred embodiment and best mode for carrying out the invention as shown in FIGS. 1–10, comprises a forward hull 23 and a contiguous aft hull 25. The inside surface of each hull is shaped to conform to the respective outside surface of a watercraft 21.

The hulls 23, 25 are hollow and watertight making the inside a flotation chamber thereby creating buoyancy of the structure. The inside consists of a void with only air in the chamber, and a removable plug provided to drain any water that may have accumulated inside the void during operations.

Figure 4:
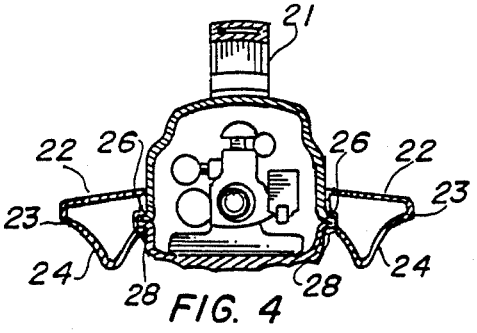
FIG. 4 is a sectional view taken along lines 4—4 of FIG. 2.
Figure 5:
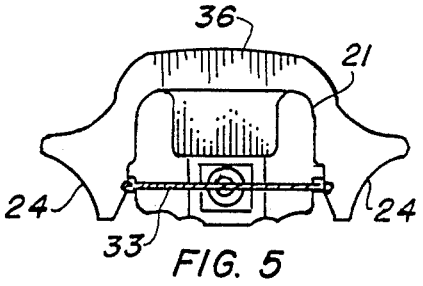
FIG. 5 is a rear elevational view of the preferred embodiment.
Figure 6:
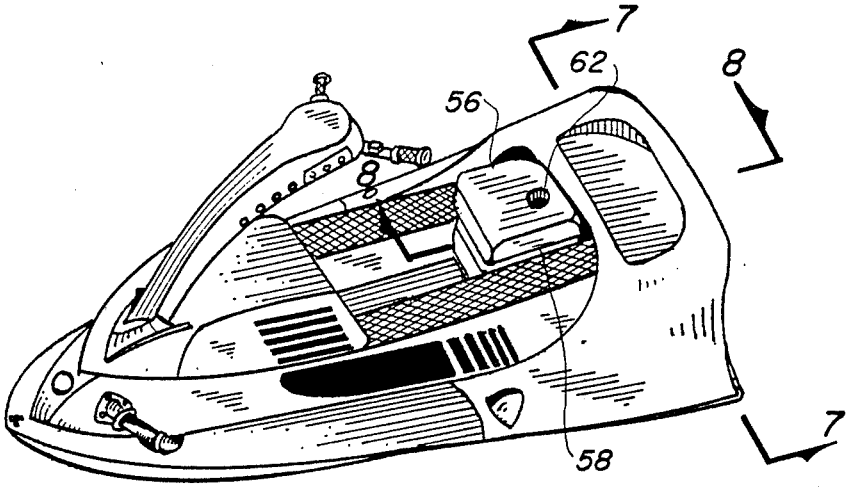
FIG. 6 is a partial isometric view of the watercraft with the hollow wedge box attached.
Figure 7:
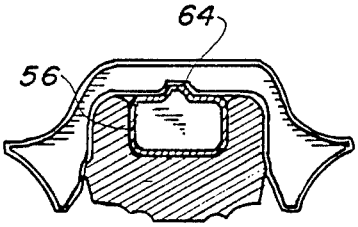
FIG. 7 is a sectional view taken along lines 7—7 of FIG. 6.

The hulls 23, 25 have a smooth outside shape following the lines of the watercraft on the front pitching gradually away from the bow to a wider base at the stern. The top plane 22 is generally flat, blending in shape to the side of the watercraft. The underside, or bottom 24, continues essentially in the shape of the hull with the outboard ends contoured radially in a sponson configuration, as depicted in FIGS. 4 and 5. The novel design of the bottom surface is such that, when speeds are increased, the hull is lifted almost out of the water by the planing action, while at lower speeds the shape allows minimum drag to be experienced.

Stability of the watercraft 21 is also achieved by the unique interface configuration of the hulls 23, 25 with the watercraft. The front underside surface, as best shown in FIG. 4, is formed away from the bottom corner of the watercraft 21 leaving a vertical gap therebetween with the bottom of each hull 23, 25 forming a sponson on each side that varies in depth and configuration. The centered section of each sponson is nearly blended into the hull near the strap 31, and is radiused in the front and substantially flat in the rear. This sponson type projection creates a type of tunnel hull when taken in conjunction with the watercraft 21.

FIG. 5 illustrates the contour of the underside of the aft hull 25 with the tunnel at the stern less pronounced on each side. With this configuration the underside shape gives a maximum of lift and manuverability while still being stable in the water.

Figure 3:
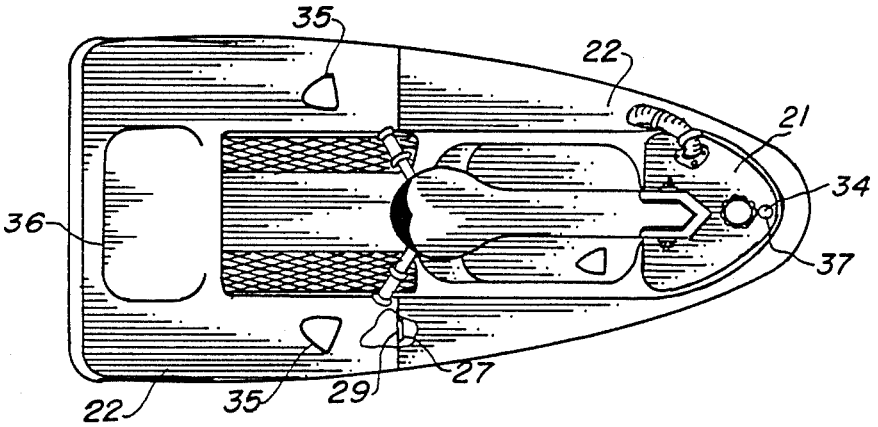
FIG. 3 is a top view of the preferred embodiment with a section cut away illustrating the attachment interface.

The bow of the forward hull 23, in the preferred embodiment, is rounded and projects forward of the watercraft 21 as best shown in FIG. 3. This design provides structural integrity for the hull 23 and a lifting surface for the entire watercraft.

Each hull 23, 25 is completely independent of each other, with the forward hull 23 having a female recess 27 and the aft hull 25 having a corresponding male boss 29. The recess and boss allow the two hull halves to mate securely when placed together, registering at the junction as pictorially illustrated in FIGS. 1 and 3.

The forward and aft hulls 23, 25 in the preferred embodiment are attached together with thermoplastic webbing such as polyester, polypropylene or nylon that is attached securely to the hull. Each hull contains separate straps 31 on the outside surface near the joint. These straps 31 are parallel in location with one having a buckle attached at the end. This buckle is the overcenter latch type that receivably accepts the end of the other strap 31 allowing a person to place each hull over the watercraft 21, thread the end of the unattached strap through the buckle and cinch the halfs together on each side forming a tight joint. Disassembly is easily accomplished by pulling the loose end outward thereby unlatching the over-center device. Other hull attaching means may also be employed; the only requirement is that the means have sufficient structural integrity to maintain the hulls together during operation.

Figure 15:
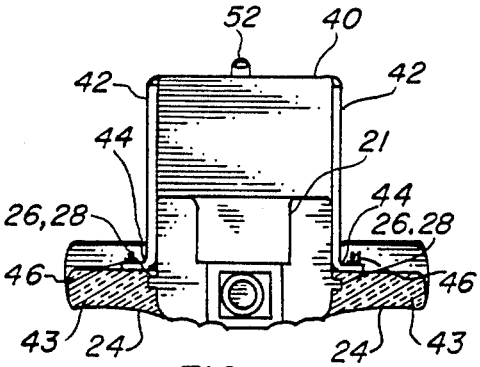
FIG. 15 is a sectional view taken along lines 15—15 of FIG. 12.
Figure 16:
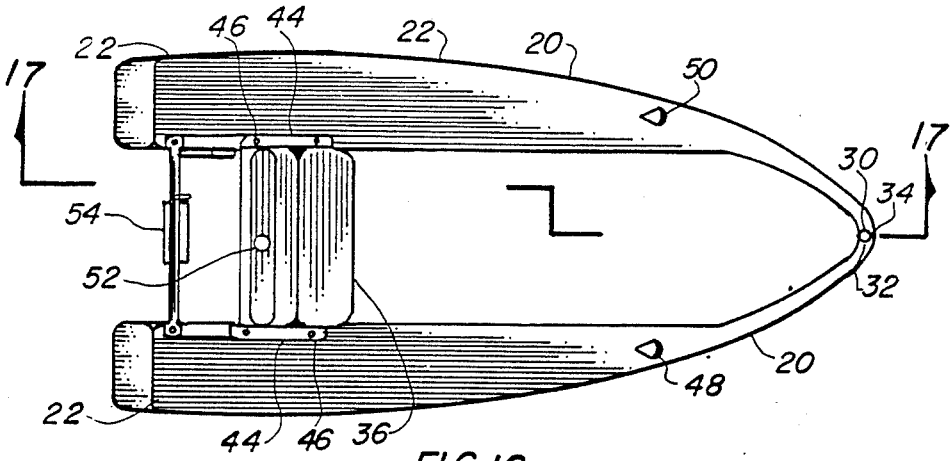
FIG. 16 is a plan view of the invention as shown in FIG. 11 with the jet powered watercraft removed.
Figure 17:
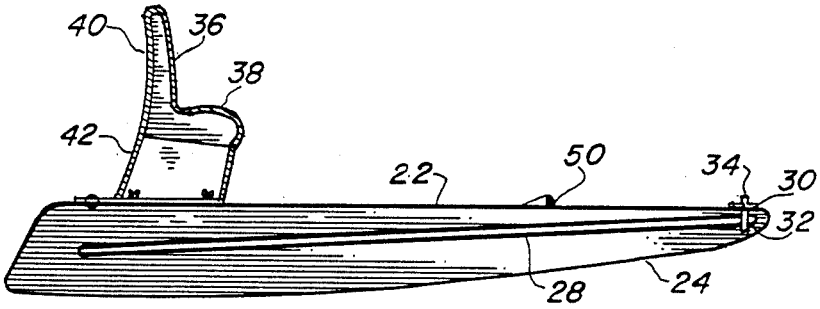
FIG. 17 is a sectional view taken along lines 17—17 of FIG. 16.
Figure 18:
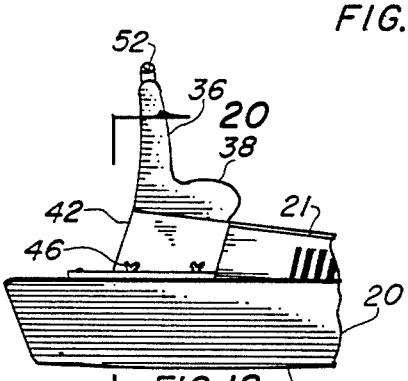
FIG. 18 is a side elevational view showing the back of the hull at right angles to the top surface.
Figure 19:
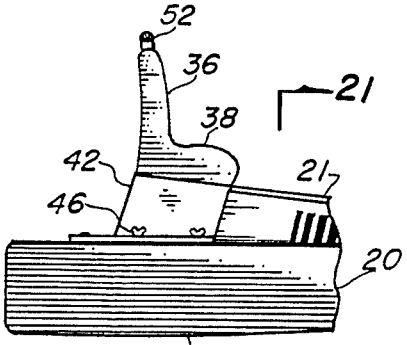
FIG. 19 is a partial side elevational view of an embodiment with the back of the hull at right angles to the top surface.
Figure 20:
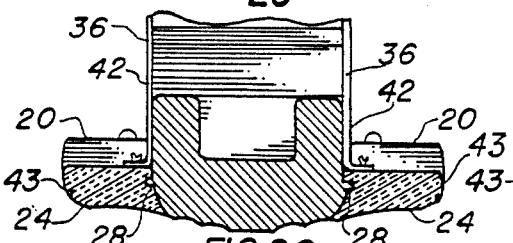
FIG. 20 is a sectional view taken along lines 20—20 of FIG. 18.
Figure 21:
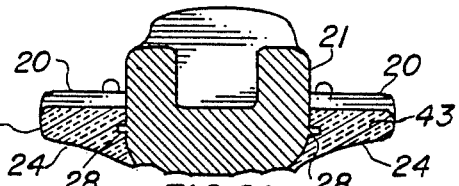
FIG. 21 is a sectional view taken along lines 21—21 of FIG. 19.

The watercraft 21 contains a parting seam or outwardly extending separation rail 26 around the horizontal periphery that is formed in the watercraft structure to separate the top and bottom half. This seam has sufficient structural integrity to be used to attach the present invention. A mating recessed channel 28 is integral with the hulls 23, 25 and is on a horizontal plane contiguous to and of the same basic shape as the watercraft body 21. The inside surface of the hulls 23, 25 contains a recessed channel 28 which is the same shape and conforms in reverse to the raised surfaces of the rail 26. The recessed channel 28 is depicted in FIGS. 4, 5, and 15. When the hulls 23, 25 are placed around the watercraft 21 they fit the contour and nest into the rails 26 creating a form fitting attachment without changes or modifications to the watercraft itself.

Figure 1:
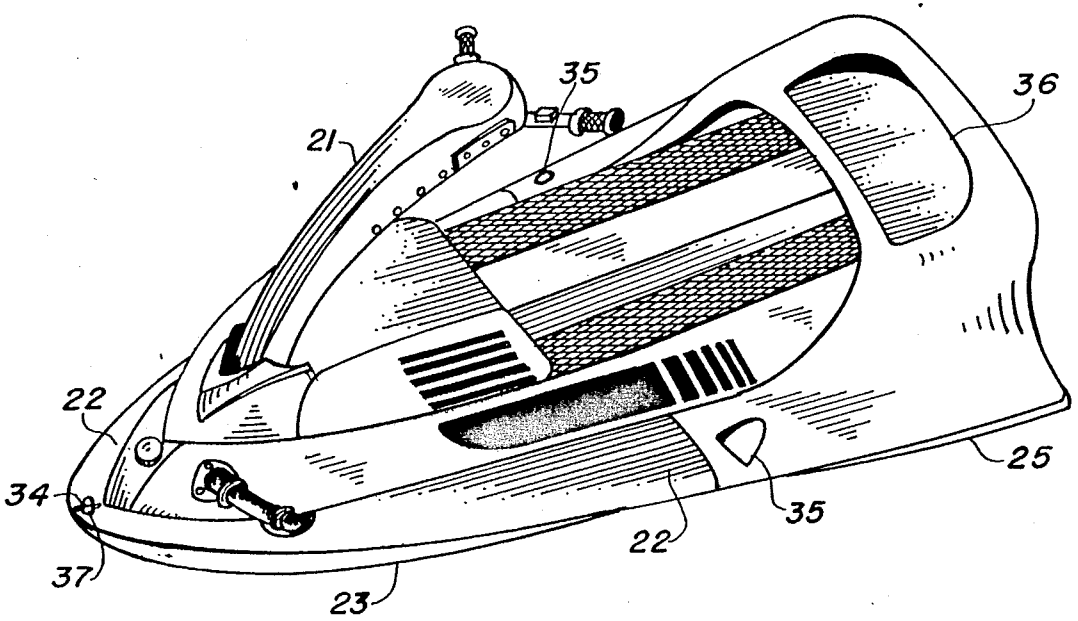
FIG. 1 is a partial isometric view of the preferred embodiment.
Figure 2:
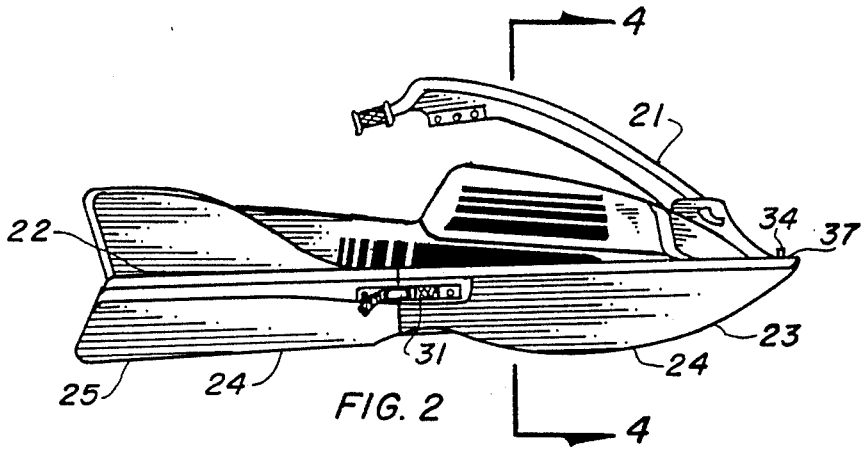
FIG. 2 is a side elevational view of the preferred embodiment with the steering mechanism elevated.
Figure 13:
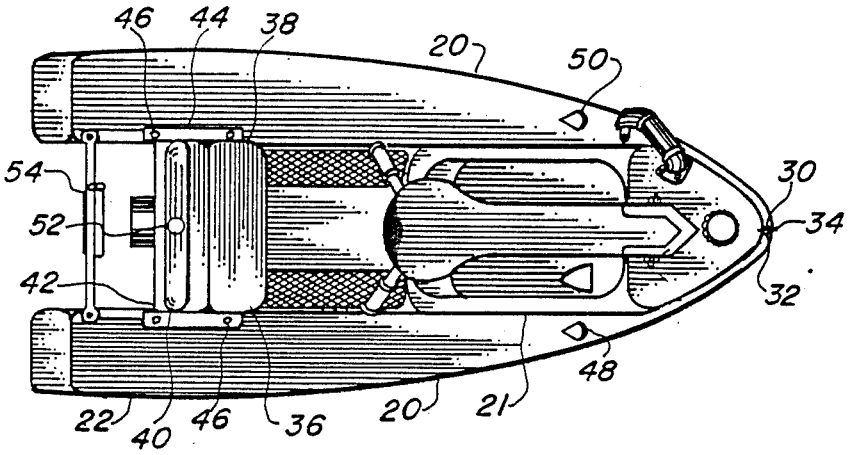
FIG. 13 is a top view of the embodiment of FIG. 11.
Figure 14:
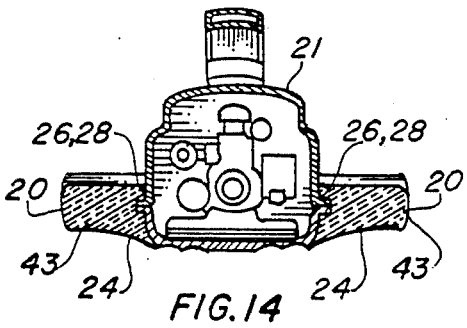
FIG. 14 is a sectional view taken along lines 14—14 of FIG. 12.

The rear of the hull 25 may be of any shape compatible to the design preference of the user, such as sloping upward, as depicted in FIG. 2, square, or at right angles to the top, as shown in FIG. 14, or angled downward, as illustrated in FIG. 13. Any combination thereof may also be utilized in the structure at this point.

The hulls 23, 25 require an irregular shaped surface on the inside to be compatible with the watercraft 21 and a smooth surface on the underside 24 with contoured radius to blend into the existing hull design. Thus, the exterior hull is broadened to achieve a low drag coefficient.

To construct the invention, any material and method of construction may be used that allows this hull configuration to be obtained, such as metal, wood fiberglass and the like with thermoplastic being preferred. The preferred embodiment employs a thermoplastic, such as polyethylene or may also use butyrate, vinyl, polystyrene, polycarbonate, acetal or urethane, or the like. A measured amount of powdered or liquid polyethylene, or the like is loaded into hollow molds having the shape of the hulls 23, 25. The mold is heated and rotated simultaneously on two axes where the hot mold fuses the plastisol into a gel, causing it to cover all surfaces with a uniform thickness. This process of rotational molding is sometimes referred to as rotomolding.

A seat 36 projects upwardly at the rear of the aft hull 25 connecting to two sides in bridge fashion allowing the watercraft 21 to be positioned underneath.

The contour of the seat fits the posterior of the operator and is so positioned to allow the watercraft to be steered from the seated position. The seat is designed with a set of female recesses located on the bottom surface of the seat. This construction adds rigidity to the seat and one of the recesses is used to lock-in-place an optional hollow wedge box 56 described infra. To further add to the comfort of the operator the hull includes a pair of heel pockets 35 that are recessed into the top surface 22 of the hull 25. As a safety precaution a safety cable or rigid bar 33 is positioned at the rear between the recessed channels 28 on each side providing a structural member to limit the movement of the opposed hulls so as to prevent any separation to occur that may inadvertently dislodge the watercraft 21 from the hull 25.

The forward hull 23 is formed in one U-shape piece with a recess on the port side to accept the exhaust pipe from the watercraft. A hole 37 is located through the top half of the bow line with a similar hole in the watercraft separation rail 26 allowing a pin 34 to be inserted into the hole locking the forward hull 23 in place.

Figure 8:
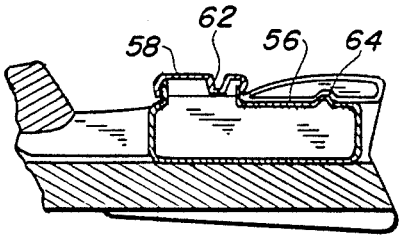
FIG. 8 is a sectional view taken along lines 8—8 of FIG. 6.
Figure 9:
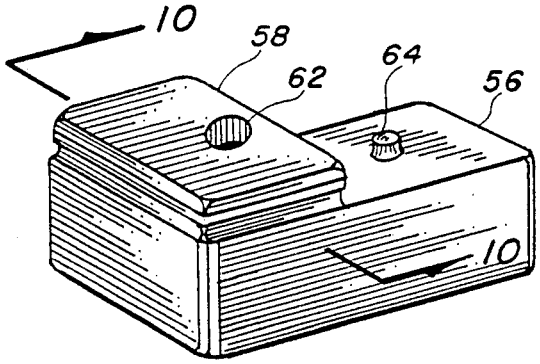
FIG. 9 is a partial isometric view of the hollow wedge box removed from the structure.
Figure 10:
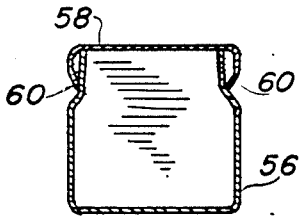
FIG. 10 is a sectional view taken along lines 10—10 of FIG. 9.
Figure 11:
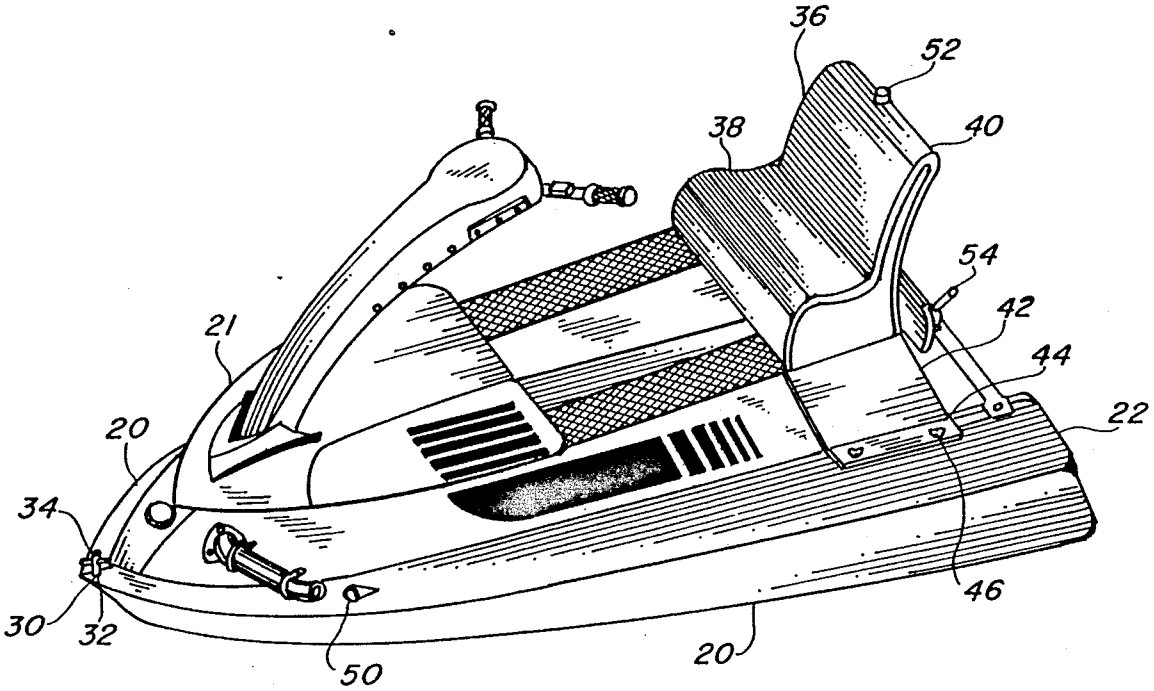
FIG. 11 is a partial isometric view of a second embodiment.
Figure 12:
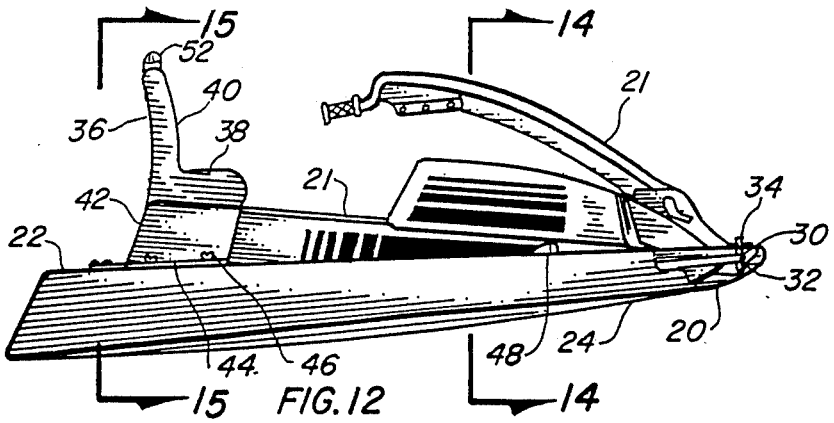
FIG. 12 is a side elevational view of the second embodiment illustrating the retaining pin arrangement.

An optional hollow wedge box 56, as shown in FIGS. 6–10, that serves as a utility storage container may be used with the preferred embodiment. The box, which is constructed preferably of a plastic material, is in a rectangular shape having a width and height that allows the box to fit under the structures integral seat 36. The box 56 includes a wedge box lid 58 having a box locking means 60 that maintains the lid 58 attached to the box 56 as best shown in FIG. 8. The lid which incorporates a lid beverage well 62, as best shown in FIG. 9, may also be used as an auxiliary seat in tandem fashion.

To securely hold the box 56 to the structure it is designed with an attachment boss 64 that protrudes upwardly from the top surface of the box as best shown in FIG. 9. The boss is located in alignment with and configured to fit into one of the female recesses located on the bottom surface of the seat 36. When the male boss and female recess are mated the box is securely held in place.

A thrust reverser 54 may also be added as an optional accessory to the craft. The reverser, which is attached to the rear aft hull 25, is comprised of a curved surface that is manually positioned to allow the discharged pressurized water to impinge on this surface reversing the direction of propulsion.

Another embodiment, as shown in FIGS. 11–21, basically differs in the separation of the two halves of the hull 20 and the attachment of the seat 36. This embodiment separates the halves longitudinally incorporating a separate seat 36 for attachment and is filled with a flotation material. FIGS. 14, 15, 20 and 21 illustrate the flotation filling employing a cellular plastic such as polyurethane in a rigid foam 43 or any suitable material, such as polystyrene, balsa wood, cork, or the like. In this embodiment polyurethane is preferably utilized due to its adaptability and ease of foaming in place. While other flotation materials are formed first and the hull built around them, the foamed in place material allows the hull 20 to be fabricated first and the material added later. With the preferred foam material, urethane bonds are formed through reaction of alcoholic hydrozyl groups and isocyanate groups. The material in liquid state expands to fill the void, using a catalyst and blowing agent, becoming rigid with an extremely low density filling the entire inside area completely.

In this embodiment the hulls 20 are secured together at the front or bow of the watercraft 21. Each hull has a similar but mating hole in a bracket or boss 30 above and/or below a hole 32 in the watercraft separation rail 26. The so called "Jet Ski" uses this hole 32 for mounting on a trailer or with a rope attached thereto for typing to a dock, etc.

Front attaching means for securing the hulls 20 through holes 30 and 32 coupling the watercraft 21 together consists of a removable pin 34 of any suitable configuration or material. This may be in the form of a capscrew and nut, or a hollow pin with a solid pin with retention means being preferred. The retention means may be in the form of a spring loaded ball locking mechanism or a simple hole to locate a cotter pin, or the like. A retaining chain may be added to captivate the pin and prevent loss.

A seat 36 is removably joined to said hulls 20 providing means to attach the hulls 20 together at the rearward end of the invention. This seat 36 has a bottom 38, back 40, and legs 42, and provides a convenient surface for the operator to be seated. While the back 40 is unessential to the invention, it does add convenience and operator comfort. The legs 42 are of such a height as to place the operator above the surface of the craft 21 and the steering mechanism is hinged upward, allowing an easy manual grip on the apparatus and the accelerator contained therewith. The seat 36 may be of any material, such as metal, wood or thermoplastic with the latter being preferred. Waterproof padding may be added to the surface of the bottom 38 and back 40, or may be integral with the seat 36 itself.

The method of attachment of the seat 36 to the hulls 20 include a bracket 44 with a surface contiguous with each hull 20. This bracket 44 is easily detachable from the hulls 20 with quick detaching means 46 in the form of quarter turn fasteners, threaded inserts with winged screws, studs in the hull 20 with wing nuts, or any suitable device. The bracket 44 is integral with the seat 36 allowing the entire assembly to be removed in one piece. This further provides the structural connection between the hulls 20 making the apparatus rigid accomplishing the desired containment of the elements into an integral float assembly.

In conformance with United States Coast Guard regulations, a set of lights may be included on the structure for position indicating and safety protection while operating within controlled waters. This is accomplished with a pair of colored lights on the bow. A red light 48 is on the port side and a green light 50 on the starboard side showing forward allowing indication of the direction of the vessel. Further, a white light 52 is located on the highest point of the seat 40. This light 52 is non-directional in that it illuminates a full 360 degrees meeting the government requirements of 270 degrees forward and 270 degrees aft. This arrangement is minimum and may be altered with a plurality of white lights on masts to further clarify the regulatory directional requirements. The running lights are electrically connected to the ignition system of the propelled watercraft 21, which operates, in most cases, from a 12-volt direct-current power source. A modification to the craft is required to bring electrical wires from the ignition system to a watertight female connector (not shown) located in the vicinity of the engine compartment. A mating watertight male plug (not shown) is wired to one of the hulls 20 with the leads attached to a strain relief device to allow the plug to be inserted into the connector freely. Internal wiring is integral with the hulls and similar secondary connectors and plugs are provided on the other hull 20 and seat 36 for attachment and detachment during assembly and disassembly of the hulls 20. The preferred power source for the lights is the watercraft's power system. However, an independent separate battery may be provided to supply the required power.

The optional manually operated thrust reverser 54 may also be positioned directly behind the watercraft discharge outlet of the propulsion system. In this embodiment the reverser is mounted on a bracket in communication with the leg brackets 44 of the seat 36. This thrust reverser 54 operates in such a manner that the discharge pressurized water impinges directly on the curved surface of the device 54 reversing the flow of water forwardly. This action propels the craft in the opposite direction, or can serve as a water braking device. An operating lever is positioned at a convenient location to allow the operator to easily lower the reverser in place.

The preferred embodiment is assembled by placing the forward hull 23 over the "Jet Ski" sliding the separation rail 26 into the recessed channel 28 and locking into place with the pin 34 at the bow. The aft hull 25 is similarly slipped into place with the female recess 27 of the forward hull 23 mating with the male boss 29. The straps 31 are then buckled together on each side holding the two halves of the hull tightly together.

In the other embodiment the assembly of the structure to the "Jet Ski" is accomplished by placing the hulls 20 on each side of watercraft 21 such that the recessed channel 28 of the hull mates with the separation rail 26 of the craft. The removable pin 34 is then placed in the holes 30 and 32 at the bow securing the front while the seat 36 is positioned at the stern connecting the rear portions of the hull together. Quick detaching means 46 secure the seat 36 to the hulls 20 completing the structural attachment. Finally, the lights are connected with the plugs inserted into the appropriate connectors and the apparatus is ready for operation.

The function of the stabilized flotation structure attached to the watercraft allows the same operating procedure to be utilized, except the added stability allows easy access at a dock or while in the open water. The seat 36 further provides operator comfort in a sitting position and the thrust reverser 54 allows flexibility of manuvering and/or braking capabilities.

While the invention has been described in complete detail and pictorially shown in the accompanying drawings, it is not to be limited to such details, since many changes and modifications may be in the invention without departing from the spirit and the scope thereof. Hence, it is described to cover any and all modifications and forms which may come within the language and scope of the claims.

We claim:

1. A watercraft stabilizing floatation structure attached to a self-propelled watercraft comprising:

(a) a forward hull having a front, rear, sides and a floatation chamber therein, said rear having a female recess, (b) an aft hull having a front, rear, sides with a floatation chamber therein, said front having a raised male boss in alignment with said female recess and said rear having an integral seat connecting the sides in bridge fashion, (c) side attaching means disposed upon each side of said forward and aft hull in such a manner as to compressibly couple them together when mating male boss and corresponding female recesses are aligned, and, (d) a recessed channel integral with said hulls on a horizontal plane contiguous to and of a shape conforming to a outwardly extending separation rail on said watercraft for retention of said hulls on said sides, said hulls adapted to be retained to said watercraft along each side and front for increasing stability to said watercraft when stationary within the water by extending the lateral floatation surface.

2. The structure as specified in claim 1 wherein said hulls are hollow and watertight.

3. The structure as specified in claim 1 wherein the inside surface of said hulls are shaped to conform to the respective outside surface of said watercraft.

4. The structure as specified in claim 1 wherein the inner section of the underside of said hulls are configured to blend into the existing hull design of said watercraft.

5. The structure as specified in claim 1 wherein said side attaching means further comprises a thermoplastic webbing disposed upon each side of said forward hull and aft hull in parallel relationship and a buckle with an over-center latch removably connected therebetween.

6. The structure as specified in claim 1 further comprising a manually operated thrust reverser or braking device positioned directly behind the watercraft discharge outlet of the propulsion system in such a manner that the discharge pressurized water impinges thereupon reversing the direction of said watercraft.

7. The structure as specified in claim 1 wherein said forward and aft hulls further comprise an integral sponson type rib formed away from the bottom corner of said watercraft on each side leaving a vertical gap the entire length of the structure in tunnel hull fashion providing stabilization and lift while propelled upon the water.

8. The structure as specified in claim 1 further comprising a hollow wedge box in rectangular shape having a width and height that allows said box to securely fit under said integral seat, said box includes a wedge box lid having box locking means that securely maintains said lid to said box.

9. The structure of claim 8 wherein said box locking means further comprises an attachment boss protruding upwardly from top surface of said box and a mating female recess within the bottom side of said integral seat in communication therebetween.

10. The structure of claim 8 wherein said wedge box lid further comprises a lid beverage well on its top surface.

11. A watercraft stabilizing floatation structure attached to a watercraft comprising:

(a) a pair of opposed hulls having a front, rear, sides and floatation chambers therein adapted to be affixed to said watercraft along each side and front for increasing stability to said watercraft when stationary within the water by extending the lateral floatation surface, (b) a front attaching means for securing said hulls together at said front, coupling said watercraft at the bow thereof, (c) a recessed channel integral with said hulls on a horizontal plane contiguous to and of a shape conforming to a outwardly extending separation rail of said watercraft (body) for retention of said hulls on said sides, (d) a seat having a bottom, and legs with rear attaching means removably joining said hulls together at said rear connecting the floatation structure together, also furnishing a surface allowing an operator to be seated at a level above said watercraft, and, (e) a set of running lights mounted to said structure for position indication and safety protection while operating within controlled waters.

12. The structure as specified in claim 11 wherein said hulls are hollow and watertight.

13. The structure as specified in claim 12 wherein said hollow hulls are filled with a rigid foam.

14. The structure as specified in claim 11 wherein the inside surface of said hulls are shaped to conform to the respective outside surface of said watercraft.

15. The structure as specified in claim 11 wherein the underside of said hulls are configured to blend into the existing hull design of said watercraft.

16. The structure as specified in claim 11 wherein said front attaching means further comprises a removable pin, having retention means, positioned within each of the pair of hulls and said watercraft providing manual detachment thereof.

17. The structure as specified in claim 11 further characterized in that said seat with rear attaching means includes a bracket having a surface contiguous with each hull, at the rear, integral with said seat removably attached therewith providing structural connection between said hulls, with said seat further containing a back that is connected to said bottom and legs for operators comfort.

18. The structure as specified in claim 11 wherein said set of running lights are electrically connected to said watercraft utilizing the ignition system thereof, and are located on the front and back of said structure.

19. The structure of claim 11 wherein said lights are powered by an independent separate battery.

20. The structure as specified in claim 11 further comprising a manually operated thrust reverser positioned directly behind the watercraft discharge outlet of the propulsion system in such a manner that the discharge pressurized water impinges thereupon allowing the direction of said watercraft to be reversed and/or serves as a watercraft braking device.

* * * * *